US005544894A

United States Patent [19]

Howard

[11] Patent Number: 5,544,894

[45] Date of Patent: Aug. 13, 1996

[54] TETHERED BALL HAVING FACIAL FEATURES AND SOUND OUTPUT

[75] Inventor: Stanley B. Howard, 6910 NW. 179th St. #203, Hialeah, Fla. 33015

[73] Assignee: Stanley B. Howard, Miami, Fla.

[21] Appl. No.: 229,199

[22] Filed: Apr. 18, 1994

[51] Int. Cl.[6] ..... A63B 67/10

[52] U.S. Cl. ..... 273/414; 273/58 C; 273/58 E; 446/297

[58] Field of Search ..... 273/58 C, 58 E, 273/58 K, 414, 413; 446/409, 486, 391, 297

[56] References Cited

U.S. PATENT DOCUMENTS

| | | | |
|---|---|---|---|
| 2,324,277 | 7/1943 | Casey et al. | 273/58 K X |
| 3,635,476 | 1/1972 | Breslow et al. | 273/414 X |
| 3,643,947 | 2/1972 | Collins | 273/414 X |
| 3,843,126 | 10/1974 | Bandy | 273/414 |
| 4,601,474 | 7/1986 | Lew et al. | 273/414 |
| 5,181,726 | 1/1993 | Piaget | 273/58 C X |
| 5,260,512 | 11/1993 | Chomette et al. | 446/409 X |

*Primary Examiner*—Mickey Yu

[57] ABSTRACT

A device for simulating the recreational activity of a person "bungee jumping". The device includes a ball having exaggerated, abnormal facial features of a person on the outer surface, a pressure-activated audio circuit inside the ball for producing a screaming sound when activated, a bungee cord attached at a first end to the ball, and a hand or wrist strap attached to the second end of the bungee cord. The device can also be used in a variety of tag or ball games.

1 Claim, 2 Drawing Sheets

TETHERED BALL HAVING FACIAL FEATURES AND SOUND OUTPUT

BRIEF SUMMARY OF INVENTION

This invention could be considered either a toy or a game, or both. As a game, it can be used for a wide variety of tag or ball games. It will consist of three basic parts: a round or oval ball, a hand or wrist strap, and a segment of bungee cord attaching the ball to the hand or wrist strap. A person playing with the toy can play alone by throwing the ball and catching it, or can play with one or more other persons. Furthermore, a varying number, from none to all of the other players, may have one of these toys for a wide variety of games.

DETAILED DESCRIPTION

Figure 1:
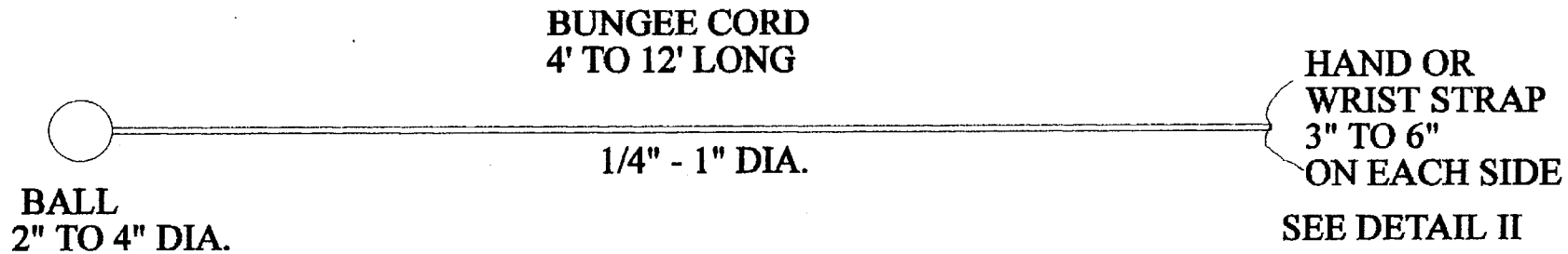
FIG. 1 is a plane view of the invention.

As shown on FIG. 1, the invention will have three parts: a ball, a segment of bungee cord, and a hand or wrist strap.

The bungee cord will consist of one type of a commercially-available stretchable cord. It may be of varying diameter, from about one-fourth inch diameter to one inch diameter. It will consist of a segment four feet to 12 feet long, which is securely attached to both the ball and the hand or wrist strap.

The ball and hand or wrist strap will be described in the following paragraphs, which are referred to, respectively, as Detail I and Detail II on FIG. 1.

Figure 2:
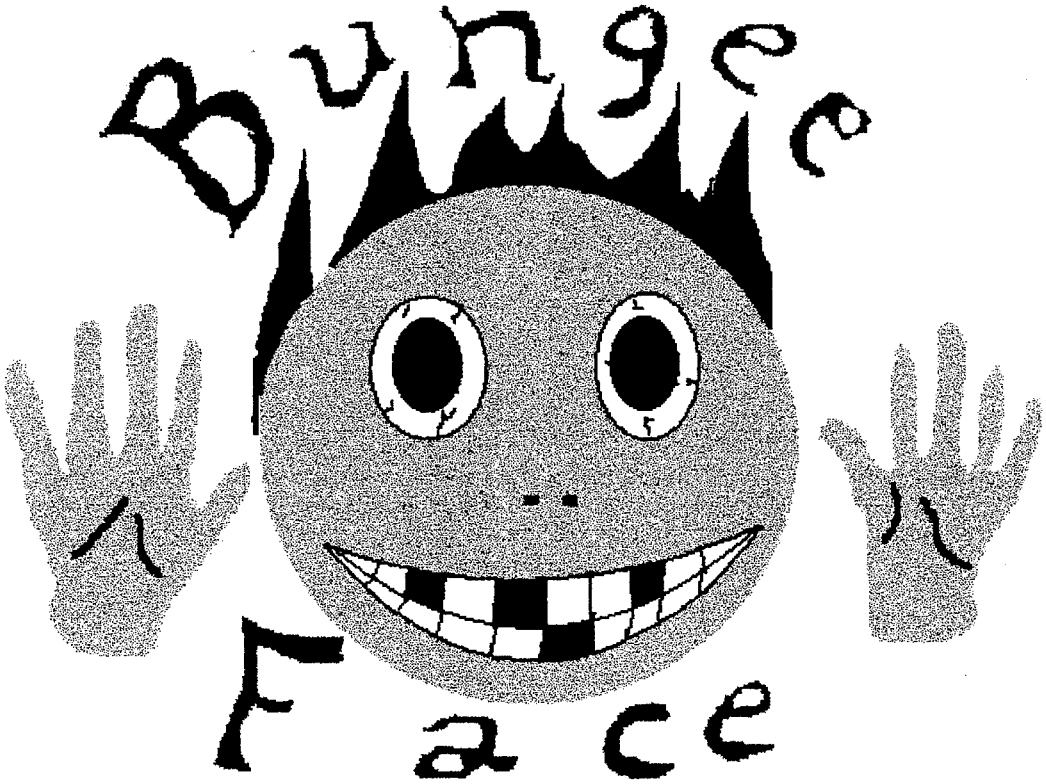
FIG. 2 shows graphics to be placed on the surface of the ball.

As the name implies, the invention can be used as a game or toy, or both. It can be thrown out and caught by the user, barehanded or with a glove. As a game, it may be used with one or more persons in a wide variety of options. For example, if two persons play, each person could attempt to catch a ball thrown by another person without getting hit, and to hit the other person with their ball without it being caught, if playing with one also, etc. Variations of such tag or catch games with several persons with a varying number of the toys could also be played. In every case, the thrower could attempt pull the ball back to his or her hand for another throw. Details I and II, which are referenced in FIG. 1, provide details of the invention, as follows:

Detail I: As shown on FIG. 1, Detail I refers to the characteristics of the ball. The ball shall be round or oval in shape, with a diameter of approximately two inches to four inches. The ball can be made of a wide variety of material. The only requirement is that it is soft enough not to cause bodily harm to another person whom it hits when thrown by another person. Other options of the ball may include the following:

1. A pressure-activated switch may be placed inside the ball, for activation when sufficient external pressure is placed on the ball. This switch may activate an audio circuit which will be housed inside the ball or elsewhere, such on the hand or wrist strap. The circuitry for this circuit, such as speakers, circuit board, etc., would be made of generic components, though it might be necessary to design a simple circuit. If located inside the ball, all components must be sufficiently padded so that it can not be exposed or cause injury to a person hit by the ball. When activated by pressure external to the ball, this circuit may produce an audio-range sound, such as a scream. Additionally, the frequency of the scream my be varied. For example, if sold in sets of two, one scream may be noticeably lower or higher than the frequency of the other one.
2. A logo drawing such as that shown on FIG. 2 may be placed on the outer covering of the ball, preferably away from the bungee cord attachment side. The logo on the ball may be this drawing but is not limited to this drawing, i.e., this drawing may be altered or altogether eliminated from the ball.
3. Synthetic "hair" streaming out from the ball around a face on the ball may also be included.

Detail II: As shown on FIG. 1, Detail II refers to the characteristics of the hand strap. The hand strap can be made of any durable, flexible material. The "strap" will actually consist of two segments, with one segment on each side of the cord connection. Each of these segments can vary in length from approximately three inches to six inches in length, and in the width from about one-half an inch to two inches. The two straps can be wrapped around the middle of the user's hand, so that the center of the strap, where the cord is attached will be at the center of the user's palm; or they can be wrapped around the user's wrist, so that the cord is attached to the part at the center of the inside of the user's wrist. In either case, the user will attach the strap to his or her hand or wrist, by wrapping the sides in opposite directions around his or her hand or wrist. The two straps on each side of the ball connection shall be tightened around the top of the hand or wrist by pulling in opposite directions. It will be held around the hand or wrist by an option such as, but not limited to, the following:

1. A mutually-adhesive material, which can easily be pulled apart and re-used repeated, with the surface on one strap facing down toward the other surface which will be facing up.
2. A buckle or latch made of a hard, durable material such a metal or plastic, which is attached to the end of one of the straps and through which the end of the other strap is pulled.
3. "Female" snap components facing down on one strap for attachment to "male" snap components on the other strap facing upward.

I claim:

1. A method of using a tethered ball to simulate the recreational activity of a person "bungee jumping," comprising:

providing a ball member having an outer surface, said ball member further having a pressure-activated audio circuit therein for producing screaming sound simulating a bungee jumper while jumping, said outer surface including a representation of a face with exaggerated, abnormal facial features located at a first region of said outer surface, said facial features including: stating eyes with distended veins and dilated pupils, wind-blown hair, and a large smile with missing teeth, and said first region is further printed thereon with the legend "Bungee Face" to further reinforce the concept that said ball member represents a bungee jumper;

attaching a bungee cord at a first end to said outer surface of said ball member at a point facing away from said first region;

attaching a hand or wrist strap to a second end of said bungee cord for attachment to a player's hand or wrist during play;

attaching said hand or wrist strap to a respective hand or wrist of a player. and throwing said ball to simulate a bungee jumper whereby said screaming sounds, said exaggerated facial features, and said printed legend cooperate to convey the concept of bungee jumping.

* * * * *